United States Patent [19]

Maddox, Jr.

[11] 4,069,965

[45] Jan. 24, 1978

[54] MAIL SLOT POUCH ASSEMBLY

[76] Inventor: Herman H. Maddox, Jr., 439 W. 55th St., Chicago, Ill. 60621

[21] Appl. No.: 644,129

[22] Filed: Dec. 24, 1975

[51] Int. Cl.[2] ..... A47G 47/12

[52] U.S. Cl. ..... 232/19; 248/101; 232/43.2

[58] Field of Search ..... 232/19–25, 232/43.2, 43.4, 45, 46, 1 E; 298/99, 101

[56] References Cited

U.S. PATENT DOCUMENTS

| | | | |
|---|---|---|---|
| 449,593 | 3/1891 | Scott | 232/46 |
| 1,640,153 | 8/1927 | Kolstad | 232/19 |
| 1,868,269 | 7/1932 | Beadle | 248/101 X |
| 3,201,072 | 8/1965 | Du Bois | 248/99 |
| 3,211,367 | 10/1965 | Jessop | 232/43.2 |
| 3,653,620 | 4/1972 | Benolt | 232/43.2 X |

*Primary Examiner*—Marion Parsons, Jr.
*Assistant Examiner*—Peter A. Aschenbrenner
*Attorney, Agent, or Firm*—Thomas R. Vigil

[57] ABSTRACT

The mail slot pouch assembly comprises a supporting bracket which is fixed to planar surfaces surrounding a mail slot in a building door, a framework and a transparent plastic bag secured to the framework, and a framework being removably supported by the bracket and positioned to receive mail therethrough into the bag to prevent the same from falling on the building floor adjacent the door.

6 Claims, 3 Drawing Figures

MAIL SLOT POUCH ASSEMBLY

BACKGROUND OF THE INVENTION

1. Field of the Invention

The field of the invention is that of mail collectors which are positioned behind mail slots in building doors. Many mail slot collectors of this type are presently classified in Class 232, subclasses 17–32.

2. Description of the Prior Art

Heretofore various proposals have been made for receptacles to be fixed behind a door and about a mail slot in the door for catching mail inserted through the slot to prevent the same from falling to the floor and being soiled, kicked, blown away or lost. Some examples of such proposals are disclosed in the following U.S. Patents:

United States Patents 458,273
483,525
491,509
805,393

More specifically, in U.S. Pat. No. 458,273 referred to above there was proposed a letter box arrangement including a mail slot in a door and a flaring flanged holder which is fixed around one side of the mail slot and which is designed to receive the upper open end of a bag therearound. The bag is held in place by a string or band, preferably elastic, provided at the upper open end of the bag.

The mail slot pouch assembly of the present invention differs in several respects from the previously proposed letter box arrangements by providing a translucent or transparent bag with a framework at the upper open end of the bag which is easily inserted into and removed from a supporting bracket fixed about one side of a mail slot.

SUMMARY OF THE INVENTION

According to the invention there is provided a mail slot pouch assembly for attachment to planar surfaces surrounding a mail slot in a door or wall of a building, said assembly comprising a supporting bracket, means for detachably fixing said bracket to the planar surfaces surrounding the mail slot, an elongate, flexible, translucent or transparent bag and a framework which is secured to the upper open end of said bag, which is configured to mate with and be removably supported by said bracket and which has a central open space which mates with and surrounds the mail slot, said bag being sufficiently deep so that most items of mail received through the mail slot will be fully received within said bag and out of reach of a hand inserted into the mail slot.

DESCRIPTION OF THE PREFERRED EMBODIMENTS

Figure 1:
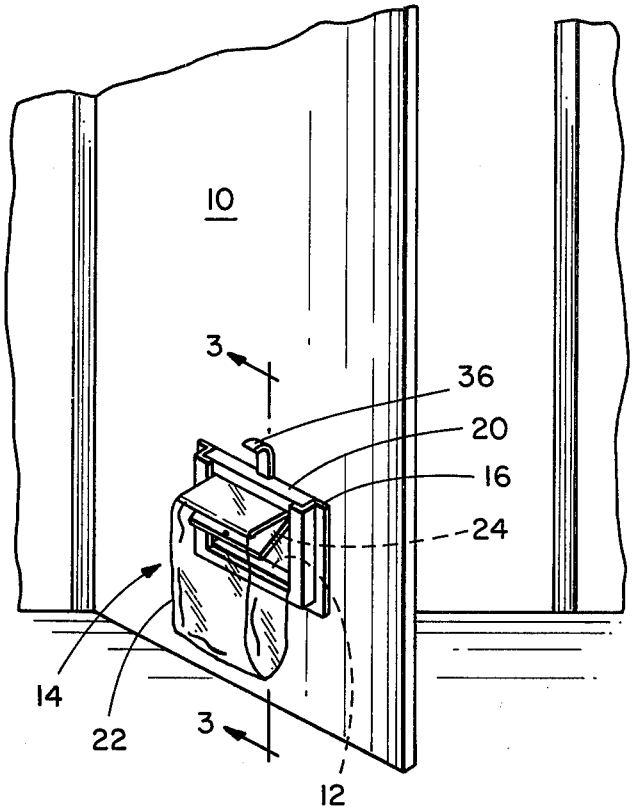
FIG. 1 is a perspective view of the mail slot pouch assembly of the present invention mounted on a door around one side of a mail slot in the door.

Referring now to the drawing in greater detail, a partially open door 10 with a mail slot 12 therein is illustrated in FIG. 1. Mounted on one side of the door 10 around the slot 12 is a mail slot pouch assembly 14 constructed in accordance with the teachings of the present invention.

Figure 2:
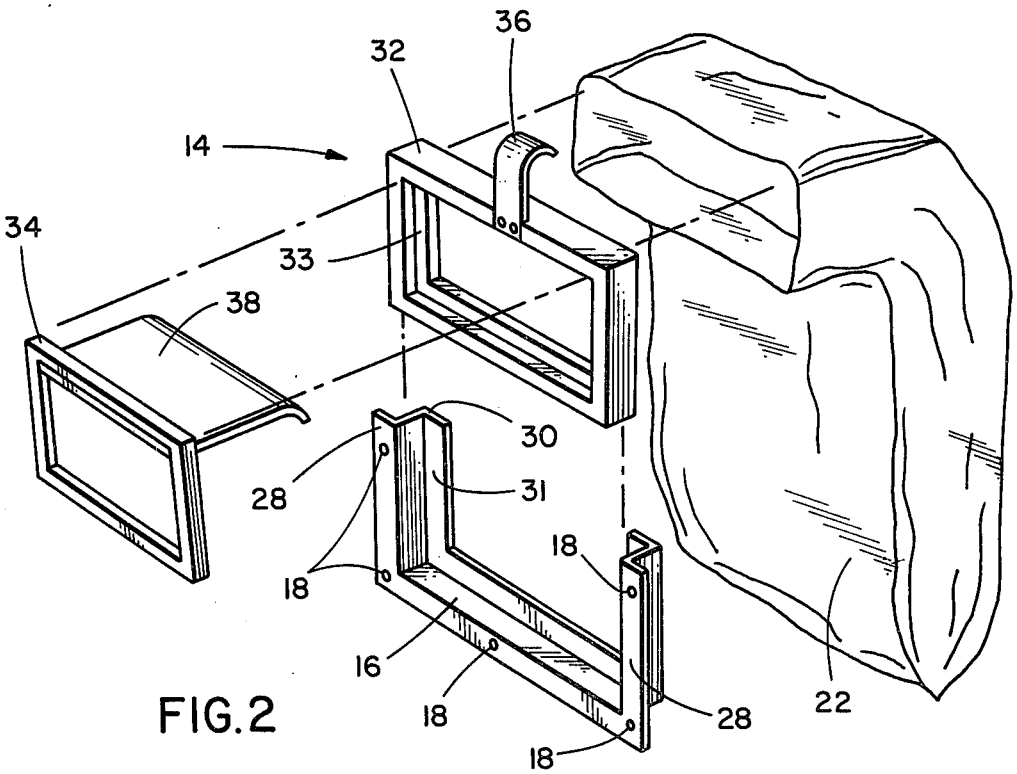
FIG. 2 is an exploded perspective view of the mail slot pouch assembly shown in FIG. 1.

The assembly 14 includes a supporting bracket 16 which is fixed to the planar surfaces of the door 10 surrounding the mail slot 12 by suitable fastening means (not shown). It will be understood that the fastening means can take many forms, e.g., an adhesive or a plurality of fasteners. In FIG. 2, the supporting bracket 16 is shown with a plurality of mounting holes 18 for receiving fasteners.

In addition to the supporting bracket 16, the assembly 14 includes a framework 20 which is easily inserted into and removed from the bracket 16 and a transparent bag 22 which has its open upper end fixed to the framework 20. As shown the framework 20 serves as a rim for the bag 22 and has a centeral open space which is aligned with the mail slot 12 when the framework 20 is received in the supporting bracket 16. Also, the bag 22 has a length or depth such that most items of mail inserted through the mail slot 12 will be fully received within the bag 22 and out of reach of a hand inserted into the mail slot 12.

In the door 10 illustrated, the mail slot 12 is normally closed on the inside of the door by a hinged cover 24 which is deflected inwardly when mail is inserted through the mail slot 12.

Of course, mail slots and covers therefore used in buildings take many different forms and are provided in walls adjacent door frames as well as in doors. Also a cover for a mail slot may be on either the outer side of the door or wall or on the inner side of the door or wall. Nevertheless, the mail slot pouch assembly 14 of the present invention can be utilized with almost all forms of mail slots regardless of the location of the mail slot and regardless of the location of the cover for the mail slot.

As best shown in FIG. 2, the supporting bracket 16 has a generally U-shape and includes a mounting flange 28 which extends about the U and which is adapted to be fixed to the planar surfaces of the door 10 adjacent the sides and bottom of the mail slot 12. A portion 30 of the bracket 16 extends outwardly from the flange 28, has a generally L-shaped cross section and is configured to form a slot 31 with the planar surfaces of the door 10 for removably receiving and holding the framework 20

Figure 3:
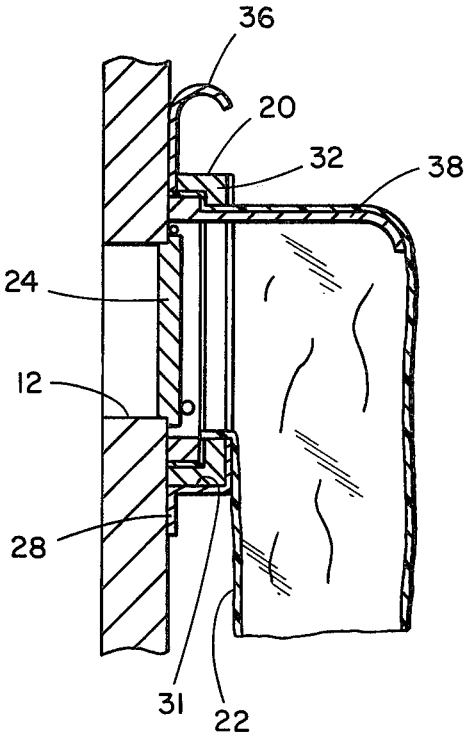
FIG. 3 is a vertical sectional view of the mail slot pouch assembly taken along line 3—3 of FIG. 1.

The framework 20 includes an outer rectangular frame member 32 which is designed to fit slidably within the slot 31 formed by the bracket 16 and which has an interior shoulder 33, and an inner rectangular frame member 34 which fits tightly into the outer frame member 32 against the shoulder 33 with the upper open end of the bag 22 fixed between the inner and outer frame members 32 and 34 as best shown in FIG. 3. The outer frame member 32 has a handle 36 extending therefrom to facilitate insertion and removal of the framework 20 into and out of the slot 31. The inner frame member 34 has a tongue or plate 38 which extends outwardly from the plane of the frame member 34 and into the bag 22 to hold the bag open behind the mail slot 12 as best shown in the Figures. The construction of the framework 20 in the mananer just described permits easy assembly of the framework 20 and the bag 22 and permits easy replacement of the bag 22.

In the illustrated embodiment, the bag 22 is made of a transparent plastic polymer material which is waterproof and which permits one easily to see whether or not there is any mail in the bag 22. Of course, if desired, the bag 22 can be made of a translucent plastic material or a see-through, colored, plastic material. Also, it will be understood that the bag 22 can be of any desired depth or length depending upon the size of the mail being received.

From the foregoing description it will be apparent that the mail slot pouch assembly 14 of the present invention provides a number of advantages some of which are described above and others of which are inherent in the invention. Specifically, the mail slot pouch assembly 14 of the present invention allows one to immediately determine whether any mail has been received without removing the bag 22 and framework 20 from the supporting bracket 16. Also the assembly 14 provides for easy insertion and removal of the framework 20 with the attached bag 22 into and out of the slot 31. Additionally, the mail slot pouch assembly 14 catches mail inserted through the mail slot 12 and thereby prevents the mail from falling to the floor and being soiled, kicked, blown away or lost.

Also from the foregoing description it will be apparent that obvious modifications and variations can be made to the mail slot pouch assembly of the invention without departing from the spirit or scope of the invention. Accordingly the scope of the invention is only to be limited as necessitated by the accompanying claims.

I claim:

1. A mail slot pouch assembly for attachment to a planar surface surrounding a mail slot in a door or wall of a building, said assembly comprising a supporting bracket having a generally u-shape, having a mounting flange extending about the U and having a portion outstanding from said flange configured to form a slot with the planar surface of the door, means for detachably fixing said bracket to the planar surface surrounding the mail slot, an elongate, flexible, translucent or transparent bag made from a plastic polymer material, a framework which is secured to the upper open end of said bag, which is configured to mate with and be removably supported in said slot formed by said bracket and which has a central open space which mates with and surrounds the mail slot, a tongue extending outwardly from said framework into said bag to maintain the bag open in the area thereof behind the mail slot for receiving mail, and said bag being sufficiently deep so that most items of mail received through the mail slot will be fully received within said bag and out of reach of a hand inserted into the mail slot.

2. The mail slot pouch assembly according to claim 1 wherein said framework includes a tongue which extends outwardly therefrom into said bag to maintain the bag open behind the mail slot for receiving mail.

3. The mail slot pouch assembly according to claim 1 wherein said framework has a handle extending therefrom to facilitate insertion of said framework into and out of said slot formed by said bracket.

4. The mail slot pouch assembly according to claim 1 wherein said framework comprises an outer frame member with an interior shoulder and an inner frame member which is tightly fitted into said outer frame member against said shoulder with the upper open end of said bag fixed between said inner and outer frame members.

5. The mail slot pouch assembly according to claim 4 wherein said inner and outer frame members are generally rectangular.

6. The mail slot pouch assembly according to claim 4, wherein said tongue is integral with, and extends outwardly from the plane of, said inner frame member.

* * * * *